United States Patent [19]

Dunn et al.

[11] Patent Number: 4,868,449

[45] Date of Patent: Sep. 19, 1989

[54] SHEET METAL SUPPORT FOR DUAL ARC DISCHARGE LAMPS AND METHOD OF MAKING

[75] Inventors: John P. Dunn, Hammondsport; Kathleen P. Bernard, Painted Post, both of N.Y.

[73] Assignee: North American Philips Corporation, New York, N.Y.

[21] Appl. No.: 191,302

[22] Filed: May 6, 1988

[51] Int. Cl.[4] ..... H01J 61/34; H01J 9/36

[52] U.S. Cl. ..... 313/25; 313/285; 445/3; 445/33

[58] Field of Search ..... 313/1, 17, 25, 284, 313/285, 288, 634; 445/3, 29, 33

[56] References Cited

U.S. PATENT DOCUMENTS 2,951,959 10/1957 Fraser et al. ..... 313/25

4,689,518 8/1987 King ..... 313/25 X

*Primary Examiner*—Kenneth Wieder

*Attorney, Agent, or Firm*—Robert T. Mayer

[57] ABSTRACT

A dual arc tube high pressure discharge lamp with a locating element for one end of each discharge tube in which the locating element comprises an H-shaped piece of stamped metal with a leg of the H inserted in the tubular electrode assemblies of each of the dual arc tubes.

12 Claims, 1 Drawing Sheet

SHEET METAL SUPPORT FOR DUAL ARC DISCHARGE LAMPS AND METHOD OF MAKING

This is an invention in the lamp art. More particularly, it involves a novel element for locating and maintaining the ends of two high pressure discharge tubes in desired positions in one lamp envelope.

This application is related to the concurrent-filed application entitled "ARRANGEMENT FOR SUPPORTING TWO DISCHARGE TUBES IN ONE ENVELOPE" applied for in the same names of the same inventors as this application and assigned to the same assignee as this application. That application is hereby incorporated by reference herein.

U.S. Pat. No. 4,689,518 entitled "High Pressure Discharge Lamp Mounting Structure" which is assigned to the assignee of this application discloses a high pressure discharge lamp with two discharge tube mounted in one envelope. The invention disclosed in that patent taught a new support structure for dual arc tube discharge lamps. The invention disclosed herein uses the frame and connectors used in previous single arc tube high pressure discharge lamps.

It is an object of the invention to simplify the manufacture of dual arc tube discharge lamps.

One of the features of the invention is that it reduces the amount of arc tube rattle present in previous dual arc tube discharge lamps.

An advantage of the invention is that it offers additional support against drop test damage.

In accordance with the invention there is provided a high pressure discharge lamp including a light transmitting envelope with a longitudinal axis and two discharge tubes. Each of the discharge tubes has a first tubular electrode assembly at a first end. Also included in a coupling means adapted to couple the discharge tubes to a source of voltage located outside the envelope. The coupling means also mounts the discharge tubes side-by-side and parallel to each other equidistant from the longitudinal axis of the envelope. The coupling means includes locating means inside each tubular electrode assembly for limiting movement of the first ends of said tubes relative to each other. A separate connector provides an electrical connection to the first tubular electrode assembly of each discharge tube. The locating means is a two legged piece of sheet metal with each of its legs inserted into an associated one of the first tubular electrode assemblies.

In accordance another aspect of the invention there is provided a method for locating the axes of dual arc discharge tubes with tubular electrode assemblies at one end in a cylindrical glass envelope. The method facilitates locating the axes of the tubes in a plane with the central axis of the envelope parallel to each other and equidistant from the central axis. It does this by locating an electrical connecting wire in the axis which will become the central axis. The method includes selecting a sheet metal blank, inserting the blank in a die and stamping the blank into a two-legged piece of metal with a bar across the legs. The center of the bar is welded to the connecting wire wherein each of the legs is adapted for insertion into an associated tubular electrode assembly.

The two legged piece of sheet metal has the bar joining its two legs at approximately their middle to form an H-shaped piece of metal.

The H-shaped piece of metal has the axes of its two legs offset from the bar so that the plane passing through the axes of the legs does not pass through the middle of the bar.

Other objects, features and advantages of the invention will become apparent from the following description and appended claims when considered in conjunction with the accompanying drawing in which:

Figure 1:
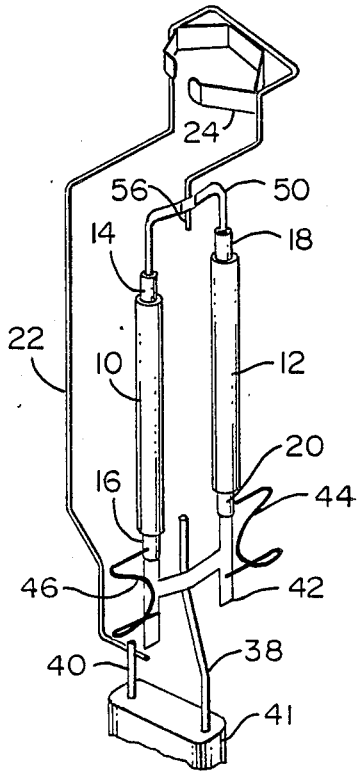
FIG. 1 is a perspective view of internal elements of the dual arc tube lamp of the invention.

It is to be understood that the drawing is not intended to be to scale but is for illustrative purposes only.

Referring to FIG. 1 there is shown two arc discharge tubes 10 and 12. Each tube has an electrode assembly 14 and 16 and 18 and 20, respectively, at each of its ends. Arc tubes 10 and 12 are supported structurally at one end by wire frame 22. Connected to the top of wire frame 22 is spring clip 24.

Figure 2:
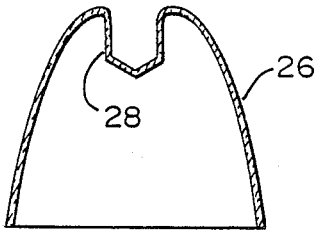
FIG. 2 is a cross-sectional view of the upper portion of the glass envelope in which the elements of FIG. 1 are enclosed.
Figure 3:
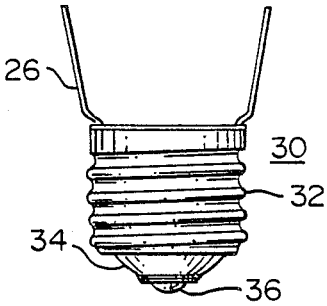
FIG. 3 is the bottom portion of the glass envelope of FIG. 2 together with the base of the lamp of the invention.

As those skilled in the art will understand, in a finished lamp the elements of FIG. 1 are enclosed in glass envelope 26 (FIG. 2). For structural support spring clip 24 engages dimple 28 (FIG. 2) of glass envelope 26. It is to be understood that a major portion of frame 22 is in a plane with the longitudinal axis of envelope 26. Envelope 26 is terminated at its bottom in a standard screw base 30 (FIG. 3) comprising a screw shell 32, insulating glass 34 and eyelet 36.

Figure 4:
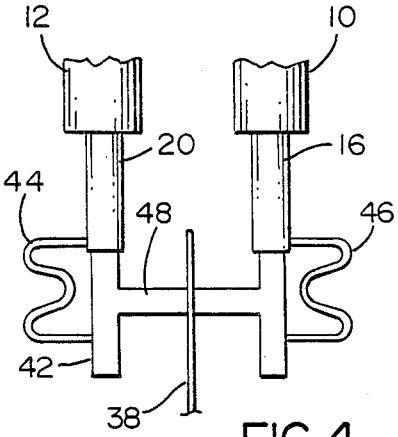
FIG. 4 is a plane view of some of the elements of FIG. 1.

Screw shell 32 and eyelet 36 provide electrical connection from a source of electrical power through lamp stem 41 to lead wires 38 and 40 (FIG. 1). Lead wire 38 is welded to the center of the connecting bar of a two legged H-shaped sheet of 22 gauge stainless steel 42 (FIGS. 1 and 4). Electrical connection to the lower electrode assemblies 16 and 20 of tubes 10 and 12 respectively is completed by welding niobium strap connectors 44 and 46 to the associated legs of H-shaped element 42 and to associated electrode assemblies 20 and 16. In one embodiment, connectors 44 and 46 were of the type disclosed in U.S. Pat. No. 4,712,040 entitled "Connector for High Pressure Lamps" and assigned to the assignee of this application.

It is to be understood that the upstanding legs of locating means comprising H-shaped metal piece 42 are inserted into the tubular openings of electrodes 16 and 20, respectively. This is done in a so-called "slip fit" manner thereby permitting relative motion between discharge tubes 10 and 12 and element 42. With electrodes having internal diameters of 0.098 inch it was found satisfactory to use legs which were 0.082 inch wide. The upper portion of lead 38 to which H-shaped element 42 is welded is located on the central axis of envelope 26. Therefore, in order to locate tubes 10 and 12 properly i.e., in a plane passing through this central axis and equidistant from it, bar 48 of H-shaped element 42 is bent (see FIG. 5). As a result a plane passing through the axes of both legs of H-shaped element 42 would not pass through the center of bar 48.

Figure 5:
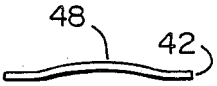
FIG. 5 is a top view of one of the elements of FIG. 4.

H-shaped element 42 is made by selecting a sheet of 22 gauge stainless steel, inserting it into a suitable progressive die and stamping it into its H-shape with the bend shown in FIG. 5. With this method the crimping step sometimes employed to obtain a "slip fit" when shaped round wire is employed as the locating means is not necessary. Also, since this method shapes element 42 in one stamping operation the manufacture of lamps by this method is simpler than some of those using shaped round wire as locating means.

Lead wire 40 is welded to wire frame 22. This provides electrical connection to electrode assemblies 14 and 18 of arc tubes 10 and 12 through wire frame 22 and stabilizing means 50. Stabilizing means 50 is a generally U-shaped piece of wire of 201 soft nickel with its legs 52 and 54 inserted into tubular electrode assemblies 14 and 18. In a finished lamp legs 52 and 54 are welded to electrode assemblies 14 and 18. In order to prevent these electrode assemblies from being crushed during welding legs 52 and 54 should be appropriately dimensioned with respect to the internal diameters of electrode assemblies 14 and 18. In one embodiment a 0.093 inch diameter wire was found to be appropriate for electrode assemblies with an internal diameter of 0.097 inch. As those skilled in the art will understand variations in internal electrode assembly diameters will result in variations in wire diameters.

Figure 6:
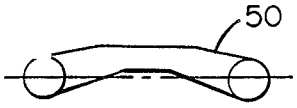
FIG. 6 is a bottom view of one of the elements of FIG. 1.
Figure 7:
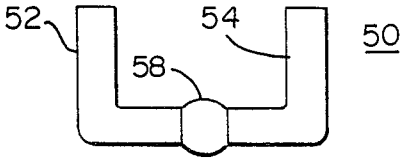
FIG. 7 is a plane view of the element of FIG. 6.

Leg 56 of wire frame 22 is centered in envelope 26. As a result, legs 52 and 54 of stabilizing means 50 are offset. That is to say, the axes of legs 52 and 54 are in a plane which does not pass through the middle of the base of wire 50 (see FIG. 6). This together with curved H-shaped element 42 locates the axes of arc tubes 11 and 13 within envelope 26 in a plane with the central axis of the envelope, parallel to each other and equidistant from that central axis. In addition, U-shaped member 50 has the middle of its base crimped so that depression 58 is formed in it. This facilitates welding U-shaped element 50 to leg 56 of wire frame 22 as is done in finished lamps. In use, wire frame 22, lead wires 38 and 40, H-shaped member 42, connectors 44 and 46 and U-shaped member 50, comprise a part of a coupling means for coupling the electrode assemblies of arc tubes 10 and 12 to a source of electrical power.

It is to be understood that high pressure tubes 10 and 12, frame 22, spring clip 24, envelope 26, lamp base 30, leads 38 and 40, lamp stem 41, and connectors 44 and 46 are all elements previously designed for use with single discharge tube high pressure lamps. By the arrangement disclosed herein all of these elements have found reuse without redesign in the dual arc lamp disclosed.

It is also to be understood that although U-shaped element 50 is shown located at the top of discharge tubes 10 and 12 and H-shaped element 42 is shown located at the bottom, in some lamps these elements could be in reversed locations.

Various modifications of the above described embodiment will be apparent to those skilled in the art. For that reason the arrangement described herein is for illustrative purposes and is not to be considered restrictive.

What is claimed is:

1. A high pressure discharge lamp including a light transmitting envelope with a longitudinal axis and two discharge tubes, each said discharge tube having a first tubular electrode assembly at a first end, coupling means adopted to couple the discharge tubes to a source of voltage located outside said envelope, said coupling means also supporting the discharge tubes sides-by-side and parallel to each other equidistant from the longitudinal axis of the envelope, said coupling means including locating means inside each tubular electrode assembly for permitting movement of the first ends of said tubes relative to each other and relative to said locating means, and a separate connector providing an electrical connection from said coupling means to said first tubular electrode assembly of each discharge tube, said locating means being a two legged piece of sheet metal with each leg inserted into one of said first electrode assemblies.

2. A high pressure discharge lamp as claimed in claim 1, wherein said two legged piece of sheet metal has a bar joining its two legs at their approximate middle to form an H-shaped piece of metal.

3. A high pressure discharge lamp as claimed in claim 2, wherein said H-shaped piece of metal has the axes of its two legs offset from its bar so that the plane passing through the axes of the legs does not pass through the middle of the bar of the H-shaped piece of metal.

4. A high pressure discharge lamp as claimed in claim 3, wherein said H-shaped piece of metal is stamped stainless steel.

5. A high pressure discharge lamp as claimed in claim 3, wherein each discharge means has a second tubular electrode assembly and said coupling means includes stabilizing means inside said second tubular electrode assembly stabilizing the top of each discharge tube while also providing an electrical connection to the top of each discharge tube, said coupling means also including a wire frame connected to said stabilizing means.

6. A high pressure discharge lamp as claimed in claim 5, wherein said stabilizing means is a U-shaped piece of wire welded to the electrode assemblies.

7. A high pressure discharge lamp as claimed in claim 6, wherein the U-shaped wire comprising the stabilizing means has the axes of its two legs offset from its base so that the plane passing through the axes of the legs does not pass through the middle of the base of the wire.

8. A high pressure discharge lamp as claimed in claim 7, wherein the middle of the base of the U-shaped member has a depression formed in it to facilitate connecting it to said frame.

9. A high pressure discharge lamp as claimed in claim 8, wherein an associated one of said legs of said U-shaped member is welded to each top electrode assembly.

10. A method for locating the axes of dual arc discharge tubes with tubular electrode assemblies at one end in a cylindrical glass envelope in the plane with the central axis of the envelope parallel to each other and equidistant from the central axis by locating an electrical connecting wire in the axis which will become the central axis, selecting a sheet metal blank, inserting the blank in a die, stamping the blank into a two-legged piece of metal with a bar across the legs and welding the center of the bar to the connecting wire wherein each of said legs is adapted for insertion into an associated tubular electrode assembly.

11. The method of claim 10, wherein the die is a progressive dye so that said bar is bent in stamping whereby a plane passing through the axes of the legs of the metal piece does not pass through the center of the bar.

12. The method of claim 11, wherein the metal piece is stainless steel.

* * * * *